US006622461B2

(12) United States Patent
Gambetti

(10) Patent No.: US 6,622,461 B2
(45) Date of Patent: Sep. 23, 2003

(54) METHOD AND SYSTEM FOR CLOSURE OF THE FLAPS OF THE END SIDES OF A PACKAGE IN THE FORM OF A SLEEVE

(75) Inventor: Mario Gambetti, Castelfranco Emilia (IT)

(73) Assignee: Baumer S.r.l., Castelfranco Emilia (IT)

( * ) Notice: Subject to any disclaimer, the term of this patent is extended or adjusted under 35 U.S.C. 154(b) by 0 days.

(21) Appl. No.: 10/056,197

(22) Filed: Jan. 24, 2002

(65) Prior Publication Data

US 2002/0104289 A1 Aug. 8, 2002

(30) Foreign Application Priority Data

Feb. 5, 2001 (IT) ..... BO2001A0057

(51) Int. Cl.[7] ..... B65B 7/20; B31B 3/60

(52) U.S. Cl. ..... 53/491; 53/376.3; 53/376.5; 53/377.2; 53/378.3; 493/128; 493/131; 493/179; 493/180; 493/183

(58) Field of Search ..... 53/376.3, 376.5, 53/376.2, 377.2, 377.8, 378.3, 462, 491, 564, 566; 493/80, 128, 131, 132, 150, 151, 167, 176, 179, 180, 182, 183

(56) References Cited

U.S. PATENT DOCUMENTS

| | | | | | |
|---|---|---|---|---|---|
| 2,318,208 | A | * | 5/1943 | First et al. | 53/564 |
| 3,298,287 | A | * | 1/1967 | Peterson et al. | 493/132 |
| 3,482,489 | A | * | 12/1969 | Neal et al. | 53/376.5 |
| 3,533,217 | A | | 10/1970 | Barnes | |
| 3,543,469 | A | * | 12/1970 | Ullman | 53/377.2 |
| 4,215,525 | A | * | 8/1980 | Nigrelli | 53/209 |
| 4,300,679 | A | * | 11/1981 | Benzschawel et al. | 53/462 |
| RE30,921 | E | * | 5/1982 | McDowell | 493/131 |
| 4,460,421 | A | | 7/1984 | Booth et al. | |
| 4,673,381 | A | | 6/1987 | Yamamoto et al. | |
| 4,932,930 | A | * | 6/1990 | Coalier et al. | 493/176 |
| 5,106,359 | A | | 4/1992 | Lott | |
| 5,148,654 | A | * | 9/1992 | Kisters | 53/377.2 |
| 5,188,695 | A | * | 2/1993 | Colton | 53/377.3 |

* cited by examiner

*Primary Examiner*—John Sipos
*Assistant Examiner*—Louis Huynh
(74) *Attorney, Agent, or Firm*—Herbert Dubno

(57) ABSTRACT

A sleeve-type half package is closed by applying two beads of glue on each of two flaps on each end of the sleeve, folding those flaps inwardly by engagement with a nonglued strip between the beads and then folding the other two flaps at each end inwardly to engage a bead of glue on each of the two first-folded flaps at each end. The folding is done by thrust members as the half package is displaced linearly along a transport path.

23 Claims, 9 Drawing Sheets

Fig. 3A
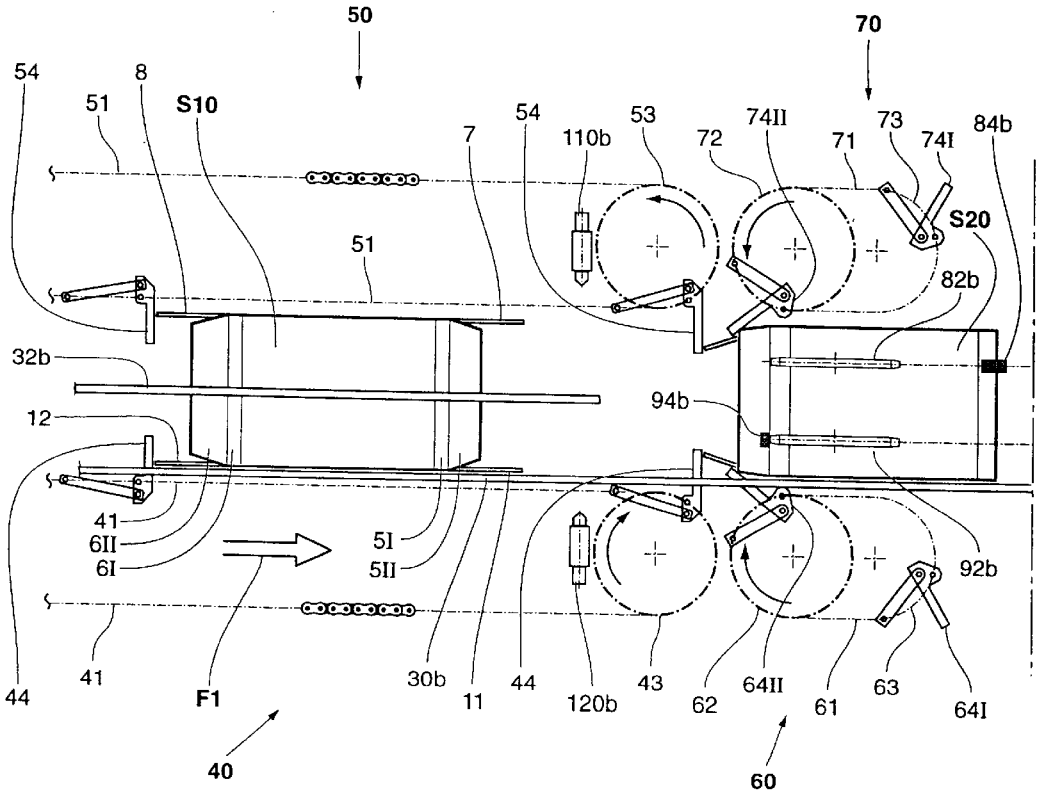
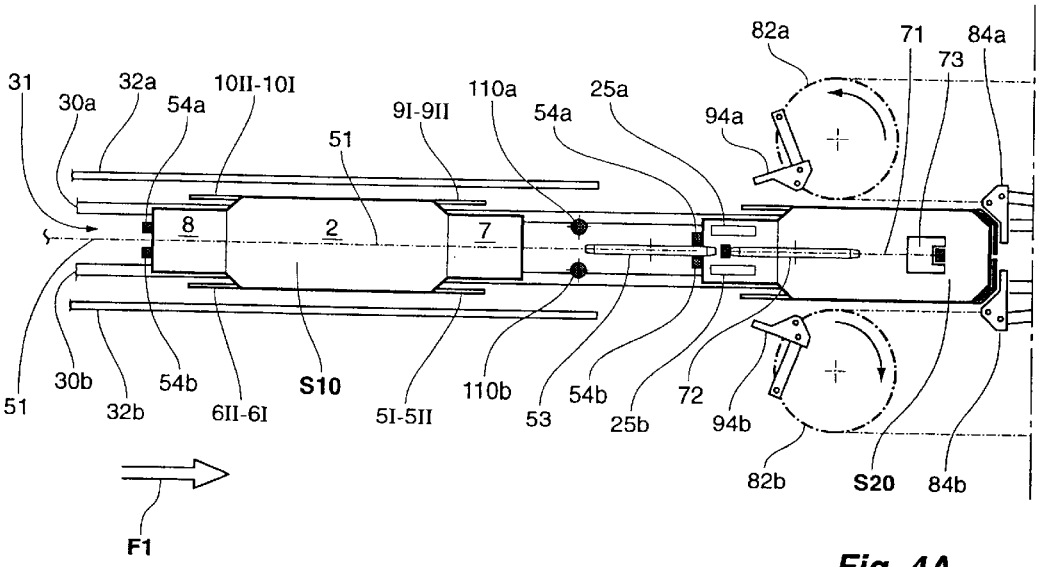
Fig. 4A

Fig. 3B
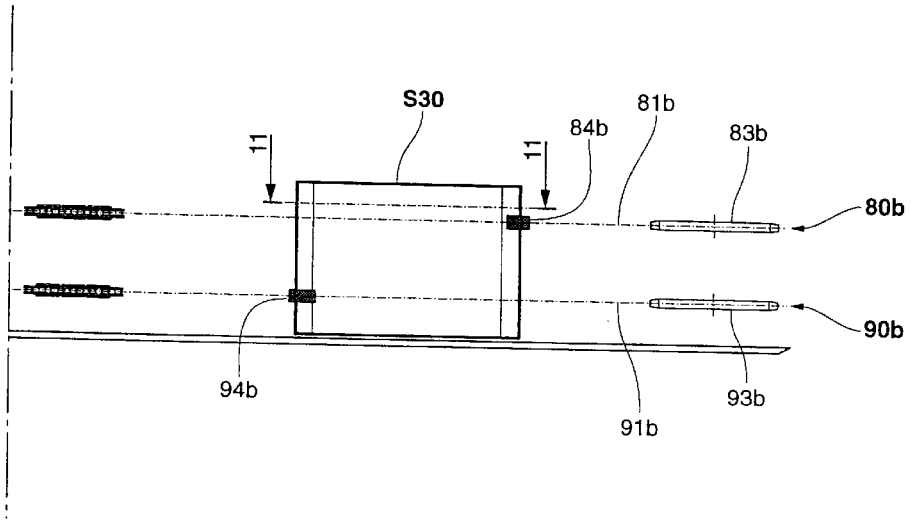
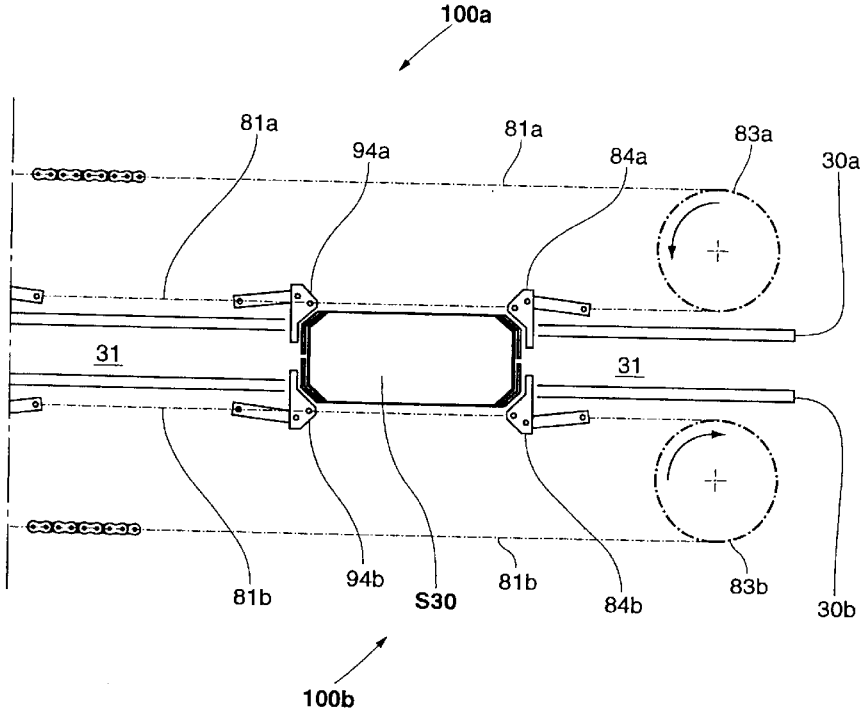
Fig. 4B

METHOD AND SYSTEM FOR CLOSURE OF THE FLAPS OF THE END SIDES OF A PACKAGE IN THE FORM OF A SLEEVE

DESCRIPTION

1. Field of the Invention

The present invention relates to a method and a system for closure, in succession, of the flaps of the two end sides of a half-package in the form of a sleeve.

More particularly, the present invention is incorporated in the field of boxing and/or packaging machines, in order to close, in individual succession, with continuous motion, the open flaps of the two end sides of half-packages in the form of a sleeve, which, for example, are obtained by means of boxing machines of the so-called "wrap-around" and/or "casing" machine type, and/or with other packaging systems.

2. Description of the Prior Art

At present, in order to close the flaps of the end sides of half-packages in the form of a sleeve, systems are provided with intermittent and/or continuous motion, which have rotary and/or fixed folders, which fold the flaps of the end sides, see for example patent U.S. Pat. No. 5,148,654 and GB-2,233,954.

These systems have a series of disadvantages.

A first disadvantage is caused by the fact that the use of rotary and/or fixed folders does not permit the use of high operative speeds, resulting in a low production capacity.

A further disadvantage is owing to the fact that the use of rotary and/or fixed folders does not make it possible to close flaps which have particular forms, such as flaps which consist of two or more sub-edges, wherein each sub-flap must be folded correctly in relation to the remaining structure of the package.

BRIEF SUMMARY OF THE INVENTION

The object of the present invention is to eliminate the above-described disadvantages.

The invention, which is characterised by the claims, solves the problem of creating a method for closing in succession the closure flaps of the two end sides of half-packages in the form of a sleeve, wherein each half-package comprises a first front flap, a first rear flap, a second front flap, a second rear flap, a third front flap, a third rear flap, a fourth front flap and a fourth rear flap, in which said method is characterised in that the said half-packages are translated in succession along a translation closure line with a front end side facing downstream and a rear end side facing upstream, and in that, for closure of the flaps of each half-package, the following operations are carried out: a)-application of glue onto the outer surface of the second front flap, which is disposed with an open configuration, and application of glue onto the outer surface of the fourth front flap, which is disposed with an open configuration; b)-folding towards the interior of the second front flap, and folding towards the interior of the fourth front flap; c)-folding towards the interior of the third front flap, and folding towards the interior of the first front flap; d)-application of glue on the outer surface of the second rear flap, which is disposed with an open configuration, and application of glue on the outer surface of the fourth rear flap, which is disposed with an open configuration; e)-folding towards the interior of the second rear flap, and folding towards the interior of the fourth rear flap; and f)-folding towards the interior of the third rear flap, and folding towards the interior of the first rear flap.

The same invention, which is characterised by the claims, also solves the problem of creating a system to close in succession the closure flaps of the two end sides of half-packages in the form of a sleeve, wherein each half-package comprises a first front flap, a first rear flap, a second front flap, a second rear flap, a third front flap, a third rear flap, a fourth front flap and a fourth rear flap, in which said system is characterised in that it comprises: >-first thrust means, in order to supply the half-packages in individual succession within a translation-closure line; >-first gluing means, which are disposed upstream from the said translation-closure line, and in the vicinity of the area of translation of the second front flaps and of the second rear flaps, in order to apply glue on the outer surfaces of the second front flaps and on the outer surfaces of the second rear flaps, whilst the half-packages are moved from upstream in the downstream direction in succession; >-second gluing means, which are disposed upstream from the said translation-closure line and in the vicinity of the area of translation of the fourth front flaps and of the fourth rear flaps, in order to apply glue on the outer surfaces of the fourth front flaps and on the outer surfaces of the fourth rear flaps, whilst the half-packages are moved from upstream in the downstream direction in succession; >-first thrust-folder means, comprising first thrust-folder posts, which move longitudinally in the vicinity of the area of translation of the second front flaps and of the second rear flaps, in order to fold towards the interior the said second front flaps and the said second rear flaps, during translation of the half-packages in the downstream direction; >-second thrust-folder means, comprising second thrust-folder posts, which move longitudinally in the vicinity of the area of translation of the fourth front flaps and of the fourth rear flaps, in order to fold towards the interior the fourth front flaps and the fourth rear flaps, during translation of the half-packages in the downstream direction; >-third thrust-folder means, comprising third thrust-folder posts, which move longitudinally in the vicinity of the area of translation of the third front flaps and of the third rear flaps, in order to fold towards the interior the third front flaps and the third rear flaps, during translation of the half-packages in the downstream direction; >-fourth thrust-folder means, comprising fourth thrust-folder posts, which move longitudinally in the vicinity of the area of translation of the first front flaps and of the first rear flaps, in order to fold towards the interior the first front flaps and the first rear flaps, during translation of the half-packages in the downstream direction; and >-support means, which extend longitudinally, in order to support the half-packages during translation in the downstream direction.

The advantages obtained by means of the present invention consist mainly in the fact of increasing the production capacities, and in that flaps with various forms can be closed.

BRIEF DESCRIPTION OF THE SEVERAL VIEWS OF THE DRAWINGS

Further characteristics and advantages of the present invention will become more apparent from the following detailed description of a preferred practical embodiment, provided here purely by way of non-limiting example, with reference to the figures of the attached drawings in which:

FIGS. 3 and 4 illustrate respectively in schematic lateral and plan view, the method and the system which are the subject of the present invention, in which there are defined two consecutive portions, indicated respectively as 3A–3B and 4A–4B;

FIGS. 3A and 3B illustrate in enlarged form respectively the portions indicated as 3A and 3B shown in FIG. 3;

FIGS. 4A and 4B illustrate in enlarged form respectively the portions indicated as 4A and 4B shown in FIG. 4;

DESCRIPTION OF THE EMBODIMENT OF THE HALF-PACKAGE WITH OPEN END SIDES

In the following description, in order to assist understanding, some elements are indicated by an Arab numeral followed by the letter "a" or "b" in order to indicate the position, respectively to the left or to the right, relative to the central longitudinal axis of flow of the machine, with reference to a person located on this axis, with his shoulders facing upstream.

In addition, other elements, such as the half-packages, disposed in succession, are indicated by a capital letter, which in some cases is followed by an arab numeral, wherein the latter is designed to indicate the position in comparison with similar elements, relative to the direction of flow of the machine.

Description of the Half-Packages in the Form of a Sleeve

Figures 1, 1A, 1B:
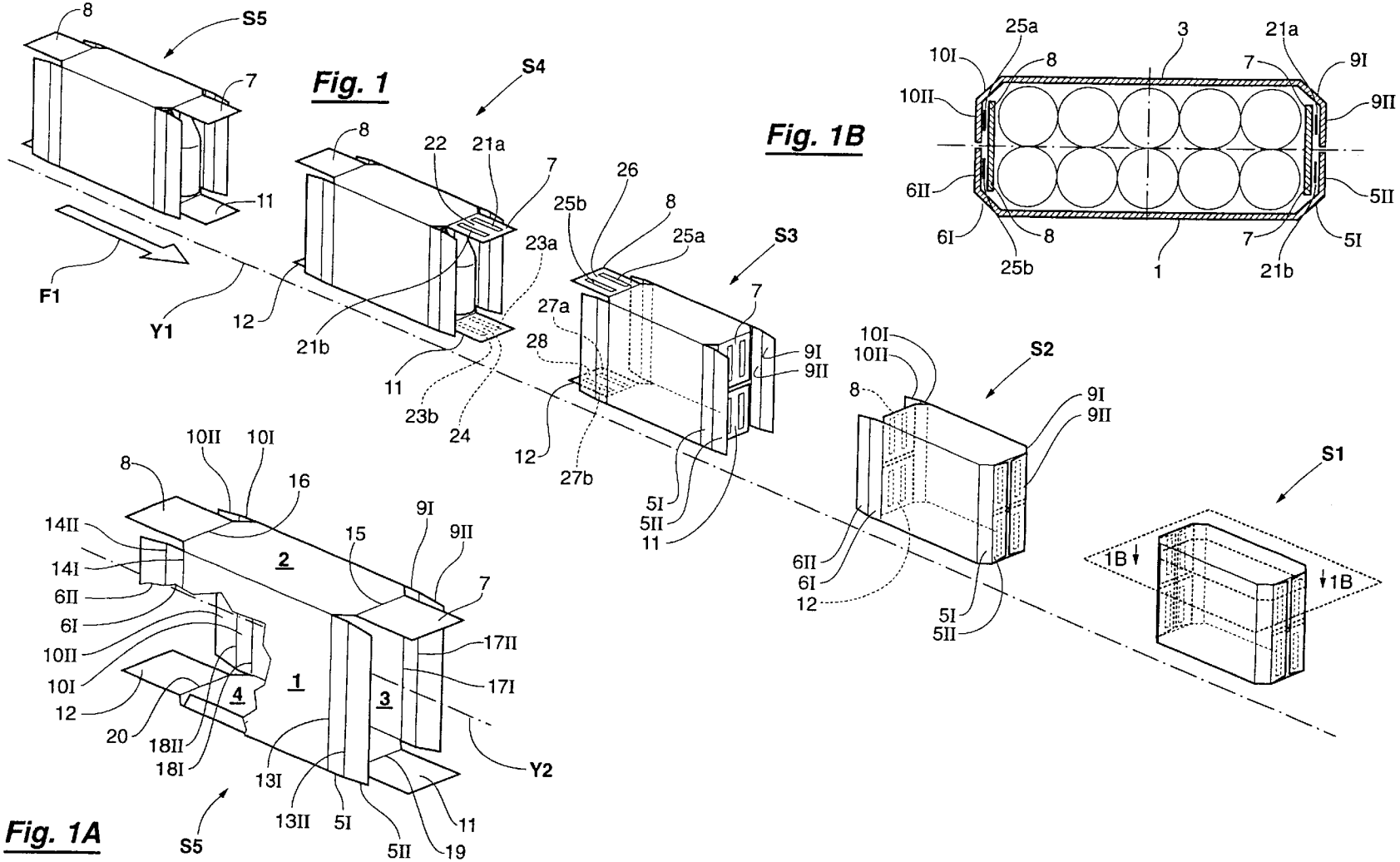
FIG. 1 illustrates in perspective view the method for closure of the closure flaps of the end sides, which is the subject of the present invention.
FIG. 1A illustrates in enlarged perspective view the package in the form of a sleeve, with the closure flaps of the end sides open.
FIG. 1B is a view in cross-section along the plane 1B—1B in FIG. 1.

With reference to FIG. 1, half-packages in the form of a sleeve, S1, S2, S3, etc., are translated in individual succession along a translation-closure line Y1, which extends longitudinally, straight, and preferably horizontally, from upstream in the downstream direction with reference to the arrow F1, and are oriented such as to have a front end side facing downstream, with corresponding open front flaps, and a rear end side facing upstream, with corresponding open rear flaps.

With reference also to FIG. 1A, which illustrates in enlarged form the half-package S5 in the form of a sleeve, with the flaps of the end sides open, shown in FIG. 1, each half-package S5 substantially extends longitudinally along its own central axis Y2, and comprises: a first panel 1, which has a first front flap 5I–5II and a first rear flap 6I–6II; a second panel 2 which has a second front flap 7 and a second rear flap 8; a third panel 3 which has a third front flap 9I–9II and a third rear flap 10I–10II; a fourth panel which has a fourth front flap 11 and a fourth rear flap 12.

In addition, in the embodiment illustrated, the first front flap 5I–5II comprises a first intermediate front sub-flap 5I, and a first end front sub-flap 5II, which are defined by means of creases 13I and 13II, the first rear flap 6I–6II comprises a first intermediate rear sub-flap 6I and a second end rear sub-flap 6II, defined by means of creases 14I and 14II, the second front flap 7 is defined by means of a crease 15, the second rear flap 8 is defined by means of a crease 16, the third front flap 9I–9II comprises a third intermediate front sub-flap 9I and a third end front sub-flap 9II which are defined by means of creases 17I and 17II, the third rear flap 10I–10II comprises a third intermediate rear sub-flap 10II, and a third end rear sub-flap 10II, which are defined by means of creases 18I and 18II, the fourth front flap 11 is defined by means of a crease 19, the fourth rear flap 12 is defined by means of a crease 20, wherein the said creases extend perpendicularly relative to the axis Y2 of longitudinal extension of the half-package S5.

Description of a Preferred Embodiment of the Method

With reference to FIGS. 1 and 1A, the half-packages, in the configuration with the flaps open, see the half-package S5, are translated in individual succession, from upstream in the downstream direction, along the line of translation-closure Y1, oriented such to have a front end side facing downstream and a rear end side facing upstream, i.e. with the axis of longitudinal extension Y2 of the said half-packages aligned relative to the said line of translation-closure Y1.

During this translation in succession, for each half-package which is being translated, see the half-package S4, glue is applied to the outer surface of the second front flap 7, which is disposed in the open configuration, by applying two longitudinal beads of glue, 21*a* and 21*b*, which are spaced transversely, in order to configure between them a longitudinal strip 22 which is free from glue, as well as by applying glue on the outer surface of the fourth front flap 11, disposed in the open configuration, by applying two longitudinal beads of glue 23*a* and 23*b*, which are spaced transversely, in order to configure between them a longitudinal strip 24 which is free from glue.

Then, with the half-packages still advancing in a downstream direction, see the half-package S3, the third front flap 7 is folded towards the interior, and the fourth front flap 11 is folded towards the interior, and glue is applied to the outer surface of the second rear flap 8, disposed in the open configuration, by applying two longitudinal beads of glue 25*a* and 25*b*, which are spaced transversely, in order to configure between them a longitudinal strip 26 which is free from glue, as well as by applying glue on the outer surface of the fourth rear flap 12, disposed in the open configuration, by applying two longitudinal beads of glue 27*a* and 27*b*, spaced transversely, in order to configure between them a longitudinal strip 28 which is free from glue.

When the half-packages are advanced further in the downstream direction, see the half-package S2, the first front flap 5I–5II is folded towards the interior, and the third front flap 9I–9II is folded towards the interior, until they are closed onto the second front flap 7 and the fourth front flap 11, see also FIG. 1B, in order to obtain mutual adhesion, obtained by means of the glue 21*a*–21*b* and 23*a*–23*b*, wherein, in this particular embodiment, only the end front half flaps 5II and 9II meet respectively the beads of glue 21*b*–23*b* and 21*a*–23*a* of the flaps 7 and 11. In the rear area of the package, again see the half-package S2, the second rear flap 8 is folded towards the interior, and the fourth rear flap 12 is folded towards the interior.

Finally, when the half-packages are advanced further in the downstream direction, see the half-package S1, the first rear flap 6I–II is folded towards the interior, and the third rear flap 10II—10II is folded towards the interior, until they are closed onto the second rear flap 8 and the fourth rear flap 12, again see FIG. 1B, in order to obtain mutual adhesion, by means of the glue 25*a*–25*b* and 27*a*–27*b*, wherein, in this particular embodiment, only the end rear half flaps 6II and 10II meet respectively the beads of glue 25*b*–27*b* and 25*a*–27*a* of the flaps 8 and 12, thus obtaining the package S1, with all the flaps of the end sides closed.

Structural Description of the Embodiment of the System

With reference to FIGS. 2A, 3A–3B and 4A–4B, the system which is the subject of the present invention comprises a translation-closure line, which extends longitudinally and straight, from upstream in the downstream direction, along which the half-packages S are translated in individual succession from upstream in the downstream direction with reference to the arrow F1.

The said translation-closure line, from upstream in the downstream direction, comprises two longitudinal support rails 30*a* and 30*b*, a lower thrust conveyor 40 and an upper thrust conveyor 50, lower gluing means 120*a*–120*b* and upper gluing means 100*a*–100*b*, downstream from which there are disposed a lower thrust-folder conveyor 60 and an upper thrust-folder conveyor 70, which are disposed specularly relative to one another, and two lateral thrust-folder conveyors 100*a* and 100*b*, which are disposed respectively along a first left side and along a second right side of the support rails 30*a*–30*b* of the translation-closure line.

In the case illustrated, the arrangement of the said last four thrust-folder conveyors 60, 70, 100*a* and 100*b*, configure a cross "+" which extends longitudinally, in the centre of which there is disposed the translation-closure line, as will be better understood hereinafter.

The guide supports 30*a* and 30*b* are transversely spaced, in order to configure between one another a longitudinal slot 31, for the reasons which will become more apparent hereinafter. In addition, in the vicinity of their upstream portion, the said two support rails 30*a* and 30*b* also have two lateral guides 32*a* and 32*b*, which are designed to channel the half-packages in the correct orientation, see S10, during the translation in the downstream direction.

The lower thrust conveyor 40 has a chain 41, which is wound in a closed path around a wheel upstream, not illustrated, and around a wheel downstream 43, wherein the said chain 41 has a plurality of thrust posts 44, in the shape of a "U", with tines 44*a* and 44*b*, which are moved in an orbit which lies on a vertical-longitudinal plane, wherein the said orbit has an operative branch which extends longitudinally in the vicinity of the area of translation of the fourth front flaps 11 and rear flaps 12, which in this case can be defined as the upper branch, wherein the said thrust posts 44 move along the longitudinal slot 31 defined by the said support rails 30*a* and 30*b*.

The upper thrust conveyor 50 has a chain 51, which is wound in a closed path around a wheel upstream, not illustrated, and around a wheel downstream 53, wherein the said chain 51 has a plurality of thrust posts 54, in the shape of a "U", with tines 54*a* and 54*b*, which are moved in an orbit which lies on a vertical-longitudinal plane, wherein the said orbit has an operative branch which extends longitudinally in the vicinity of the area of translation of the second front flaps 7 and rear flaps 8, which in this case can be defined as the lower branch.

The lower thrust-folder conveyor 60 has a chain 61, which is wound in a closed path around a wheel upstream 62 and around a chain guide 63 downstream, illustrated schematically, wherein the said chain 61 has a plurality of thrust-folder posts 61I 64II, and, more particularly, front thrust-folder posts 64I and rear posts 64II, which are moved in an orbit which lies on a vertical-longitudinal plane, wherein the said orbit has an operative branch which extends longitudinally in the vicinity of the area of translation of the fourth front flaps 11 and rear flaps 12, which in this case can be defined as the upper branch, wherein the said thrust-folder posts 64I and 64II move along the longitudinal slot 31 defined between the said support rails 30*a* and 30*b*.

The upper conveyor 70 has a chain 71, which is wound in a closed path around a wheel upstream 72 and around a chain guide 73 downstream, illustrated schematically, wherein the said chain 71 has a plurality of thrust-folder posts 74I 74II, and, more particularly, front thrust-folder posts 74I and rear posts 74II, which are moved in an orbit which lies on a vertical-longitudinal plane, wherein the said orbit has an operative branch which extends longitudinally in the vicinity of the area of translation of the second front flaps 7 and rear flaps 8, which in this case can be defined as the lower branch.

On the left hand side of the said machine, at a level contained between the upper branch of the lower conveyor 60 and the lower branch of the upper conveyor 70, there is disposed the conveyor 100*a*, which has its upstream portion designed to operate within the operative context of the said lower 60 and upper 70 conveyors.

In this particular embodiment, the left-hand conveyor 100*a* comprises two conveyors, an upper conveyor 80*a* and a lower conveyor 90*a*, but it can comprises a single chain-conveyor. The upper conveyor 80*a* comprises an upper chain 81*a*, which is wound in a closed path around an upper upstream wheel 82*a*, and around an upper downstream wheel 83*a*, wherein the said chain 81*a* has a plurality of respective upper thrust-folder posts 84*a*, which are moved in an orbit which lies on a horizontal-longitudinal plane, wherein the said orbit has an operative branch which extends longitudinally in the vicinity of the said area of translation of the third front flaps 9I–9II and rear flaps 10I–10II, wherein, more particularly, but not necessarily, see also FIG. 11, the said upper posts 84*a* have an operative surface with a shaped profile comprising an inclined segment 84*a*1 and a transverse segment 84*a*2. The lower conveyor 90*a* comprises a lower chain 91*a*, which is wound in a closed path around a lower upstream wheel 92*a* and around a lower downstream wheel 93*a*, wherein the said chain 91*a* has a plurality of respective lower thrust-folder posts 94*a*, which are moved in an orbit which lies on a horizontal-longitudinal plane, wherein the said orbit has an operative branch which extends longitudinally in the vicinity of the area of translation of the third front flaps 9I–9II and rear flaps 10I–10II, wherein, more particularly, but not necessarily, see also FIG. 11, the said lower posts 94*a* have an operative surface with a shaped profile comprising an inclined segment 94*a*1 and a transverse segment 94*a*2.

In this particular embodiment, the left-hand conveyor 100*a* comprises two conveyors, an upper conveyor 80*a* and a lower conveyor 90*a*, The upper conveyor 80*a* comprises an upper chain 81*a*, which is wound in a closed path.

In this particular embodiment, the right-hand thrust-folder conveyor 100*b* comprises two conveyors, an upper conveyor 80*b* and a lower conveyor 90*b*, but it can comprises a single chain-conveyor. The upper conveyor 80*b* comprises an upper chain 81*b*, which is wound in a closed path around an upper upstream wheel 82*b*, and around an upper downstream wheel 83*b*, wherein the said chain 81*b* has a plurality of respective upper thrust-folder posts 84*b*, which are moved in an orbit which lies on a horizontal-longitudinal plane, where in the said orbit has an operative branch which extends longitudinally in the vicinity of the area of translation of the first front flaps 5I–5II and rear flaps 6I–6II, wherein, more particularly, but not necessarily, see also FIG. 11, the said upper posts 84*b* have an operative surface with a shaped profile comprising an inclined segment 84*b*1 and a transverse segment 84*b*2. The lower conveyor 90*b* comprises a lower chain 91*b*, which is wound in a closed path around a lower upstream wheel 92*b* and around a lower downstream wheel 93*b*, wherein the said chain 91*b* has a plurality of respective lower thrust-folder posts 94*b*, which are moved in an orbit which lies on a horizontal-longitudinal plane, wherein the said orbit has an operative branch which extends longitudinally in the vicinity of the area of translation of the third front flaps 5I–5II and rear flaps 6I–6II, wherein, more particularly, but not necessarily, see also FIG. 11, the said lower posts 94*b* have an operative surface with a shaped profile comprising an inclined segment 94*b*1 and a transverse segment 94*b*2.

In addition, the two upper gluing devices 110*a* and 100*b* are disposed upstream from the upper conveyor 70, and the two lower gluing devices 120*a* and 120*b* are disposed upstream from the lower conveyor 60.

The system is also provided with mechanical and/or electrical and/or electronic and/or computerised devices to synchronise the various operative elements with one another.

Functional Description of the Embodiment of the System

With particular reference to FIGS. 1, 2 and 3A–3B, the half-packages, see the half-package S10 in FIGS. 2 and 3A–4A, with the flaps of the end sides open, are thrust in the downstream direction by means of the lower thrust posts 44, and more particularly 44*a*–44*b*, of the lower thrust conveyor 40, and by means of the thrust posts 54, and more particularly 54*a*–54*b*, of the upper conveyor 50, which, respectively, press on the rear edges of the fourth rear flap 12 and of the second rear flap 8.

Figure 5:
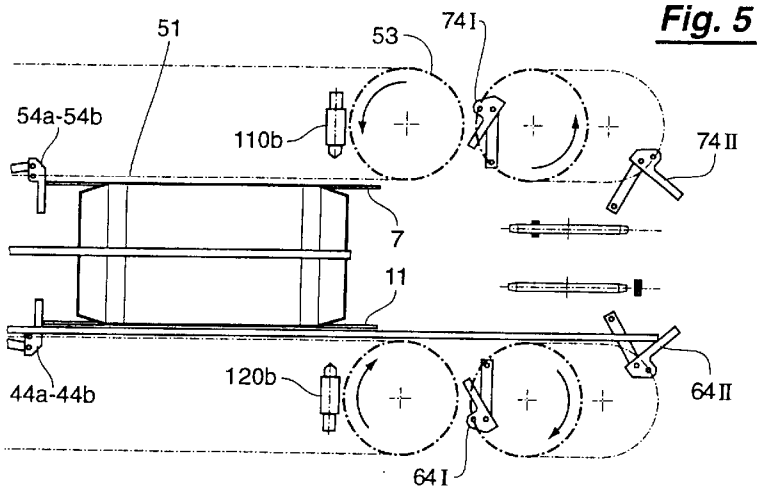
Figure 5A:
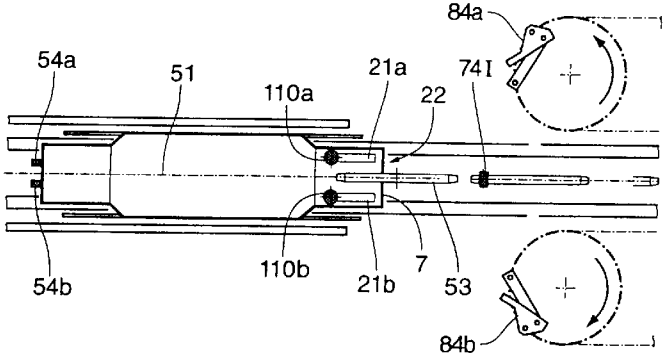

With the half-packages advancing in the downstream direction, see also FIGS. 5–5*a*, the upper gluing devices 110*a*–110*b*, which are actuated in phase ratio, apply to the outer surface of the second front flap 7 two longitudinal beads of glue 21*a* and 21*b*, between which there is disposed a longitudinal strip 22 without glue, and, similarly, by means of the lower gluing devices 120*a*–120*b*, which are also actuated in phase ratio, see also the half-package S4 in FIG. 1, apply to the outer surface of the fourth front flap 11 two longitudinal beads of glue 23*a* and 23*b*, between which there is disposed a longitudinal strip 24 without glue, thus producing the half-package S4 illustrated in FIG. 1.

Figure 6:
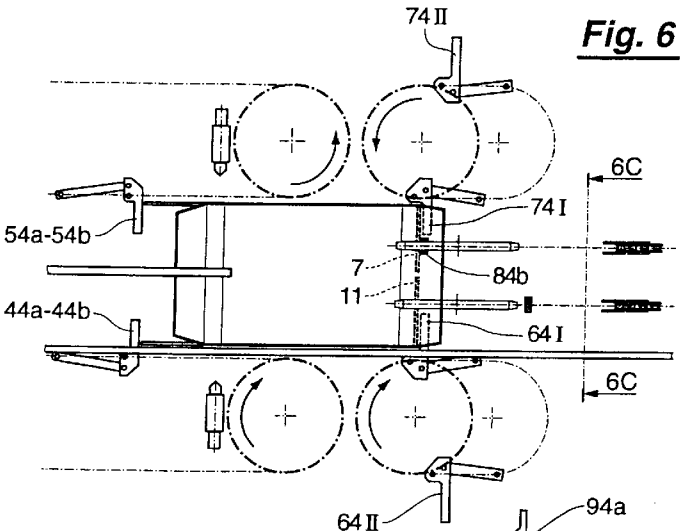
FIGS. 5–5A, 6–6A, 7–7A, 8–8A, 9–9A and 10–10A illustrate six operative steps schematically in lateral and plan view, and in succession.
Figure 6A:
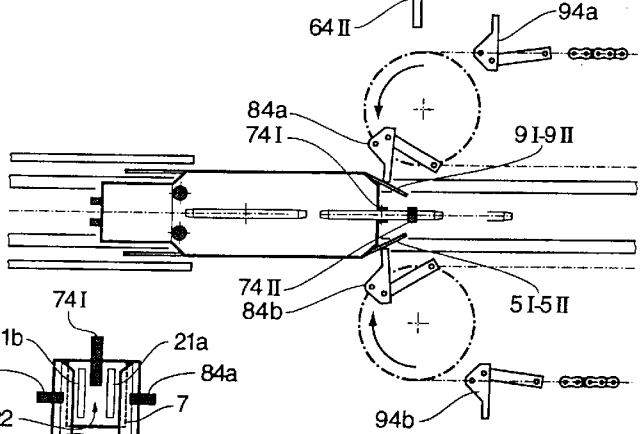
Figure 6C:
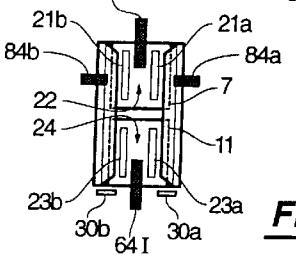
FIG. 6C is a schematic view according to the line 6C—6C in FIG. 6.

When the half-packages are advanced further downstream, see FIGS. 6, 6A and 6C, at the top, a thrust-folder post 74I, which is actuated in phase ratio, and moves from the top downwards, meets the second front flap 7, in the vicinity of its median transverse point, in which the longitudinal strip 22 without glue is disposed, see in particular FIG. 6C, and the said second front flap 7 is then folded towards the interior, without touching the two beads of glue 21*a* and 21*b*. Similarly, at the base, a first thrust-folder post 64I, which is actuated in phase ratio, and moves from the base upwards, meets the fourth front flap 11, in the vicinity of its median transverse point, in which the longitudinal strip 24 without glue is disposed, again see in particular FIG. 6C, and then folds the said fourth front flap 11 towards the interior, without touching the two beads of glue 23*a* and 23*b*.

Immediately afterwards, again see FIGS. 6 and 6A, a front folder post 84*a* of the conveyor 80*a*, which is driven in phase ratio, begins to fold towards the interior the third front flap 9I–9II, and, on the other side, a front upper thrust-folder post 84*b* of the conveyor 80*b*, which is driven in phase ratio, begins to fold the first front flap 5I–5II towards the interior.

Figure 7:
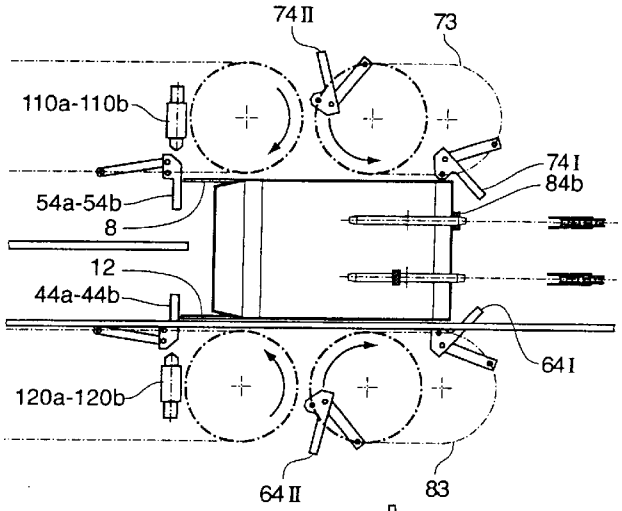
Figure 7A:
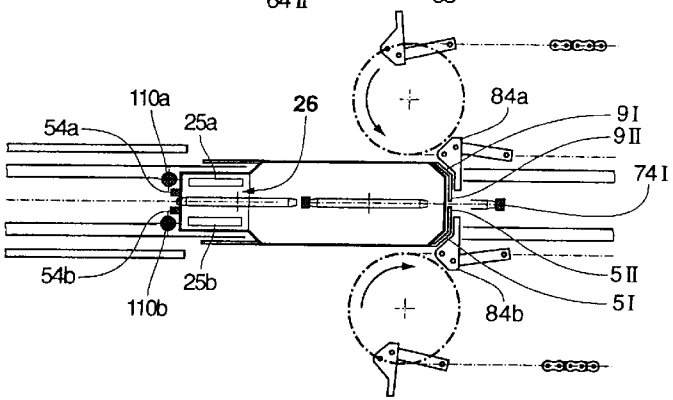

As the half-packages are advanced further in the downstream direction, when the front flaps 9I–9II and 5I–5II are partially closed, in order to prevent re-opening of the front flaps 7 and 11, the upper thrust-folder post 74I is deflected upwards, by being moved along the chain guide 73, and the lower trust-folder post 74I is deflected downwards, by being moved along the chain guide 83, and, thus, see also FIGS. 7 and 7A, the thrust-folder post 84*a* of the conveyor 80*a* and the thrust-folder post 84*b* of the conveyor 80*b*, fold definitively towards the interior the third front flap 9I–9II and the first front flap 5I–5II.

Subsequently, during execution of the said operations, the upper gluing devices 100*a*–100*b*, which are actuated in phase ratio, have applied to the outer surface of the second rear flap 8 two longitudinal beads of glue 25*a* and 25*b*, between which there is disposed a longitudinal strip 26 without glue, and, similarly, the lower gluing devices 120*a*–120*b*, which are also actuated in phase ratio, see also the half-package S3 in FIG. 1, have applied to the outer surface of the fourth rear flap 12 two longitudinal beads of glue 27*a* and 27*b*, between which there is disposed a longitudinal strip 29 without glue.

Figure 8:
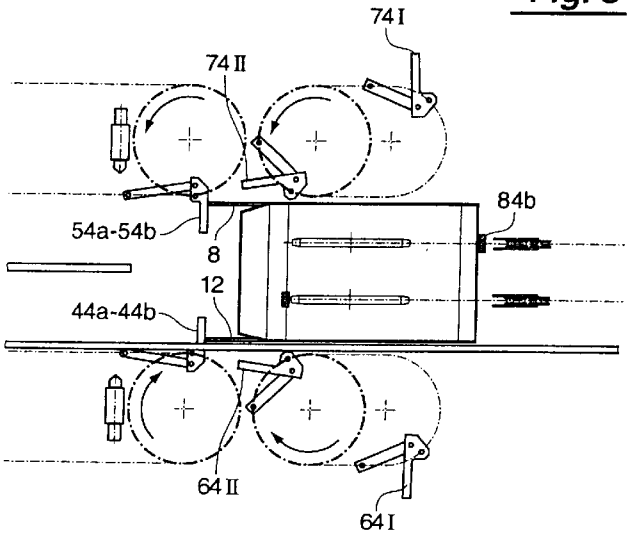
Figure 8A:
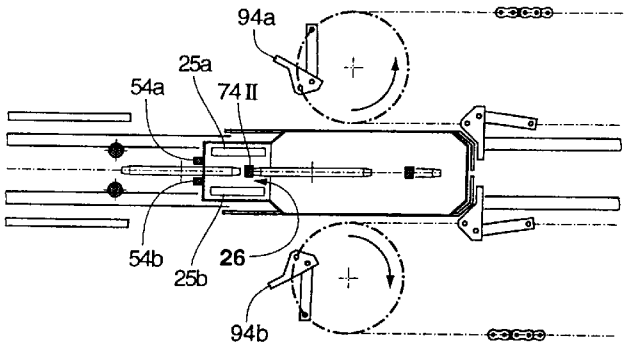
Figure 9:
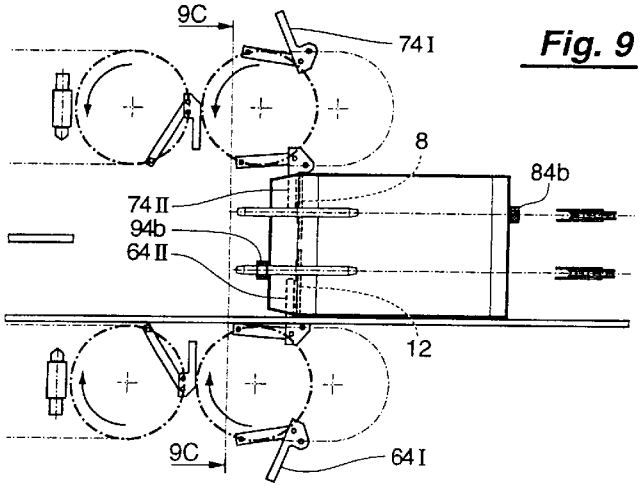
Figure 9A:
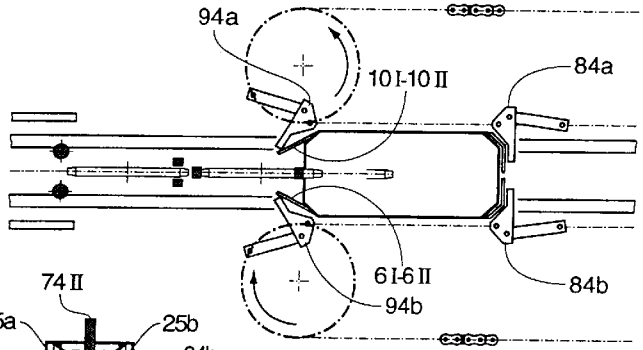
Figure 9C:
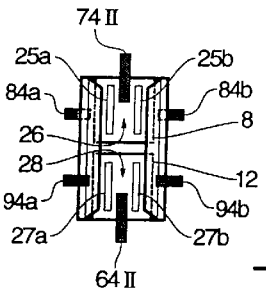
FIG. 9C is a schematic view according to the line 9C—9C in FIG. 9.

The half-package thus obtained, with the front end side closed, see FIGS. 8 and 8*a*, is advanced further in the downstream direction, again thrust by the upper thrust posts 54*a*–54*b* and lower posts 44*a*–44*b* (see also the package S20 in FIG. 2), and, when the rear portion of the said half-package reaches the vicinity of the conveyors 70 and 60, the second thrust-folder posts 74II, which move from the top downwards, and pass through the tines 54*a*–54*b*, meet the second rear flap 8, in the vicinity of its median transverse point, in which the longitudinal strip 26 without glue is disposed, and then, see FIGS. 9–9A–9C, fold the said second rear flap 8 towards the interior, without touching the two beads of glue 25*a* and 25*b*, and, similarly, at the base, the second thrust-folder posts 64II, which are actuated in phase ratio, move from the base upwards, meet the fourth rear flap 12, in the vicinity of its median transverse point, in which the longitudinal strip 28 without glue is disposed, and then fold the said fourth rear flap 12 towards the interior, without touching the two beads of glue 27*a* and 27*b*.

Immediately afterwards, again see FIGS. 9, 9A and 9C, the rear folder posts 94*a* of the conveyor 90*a* begin to fold the third rear flap 10I–10II towards the interior, and, on the other side, the rear thrust-folder posts 94*b* of the conveyor 90*b* begin to fold the first rear flap 6I–6II towards the interior.

Figure 2:
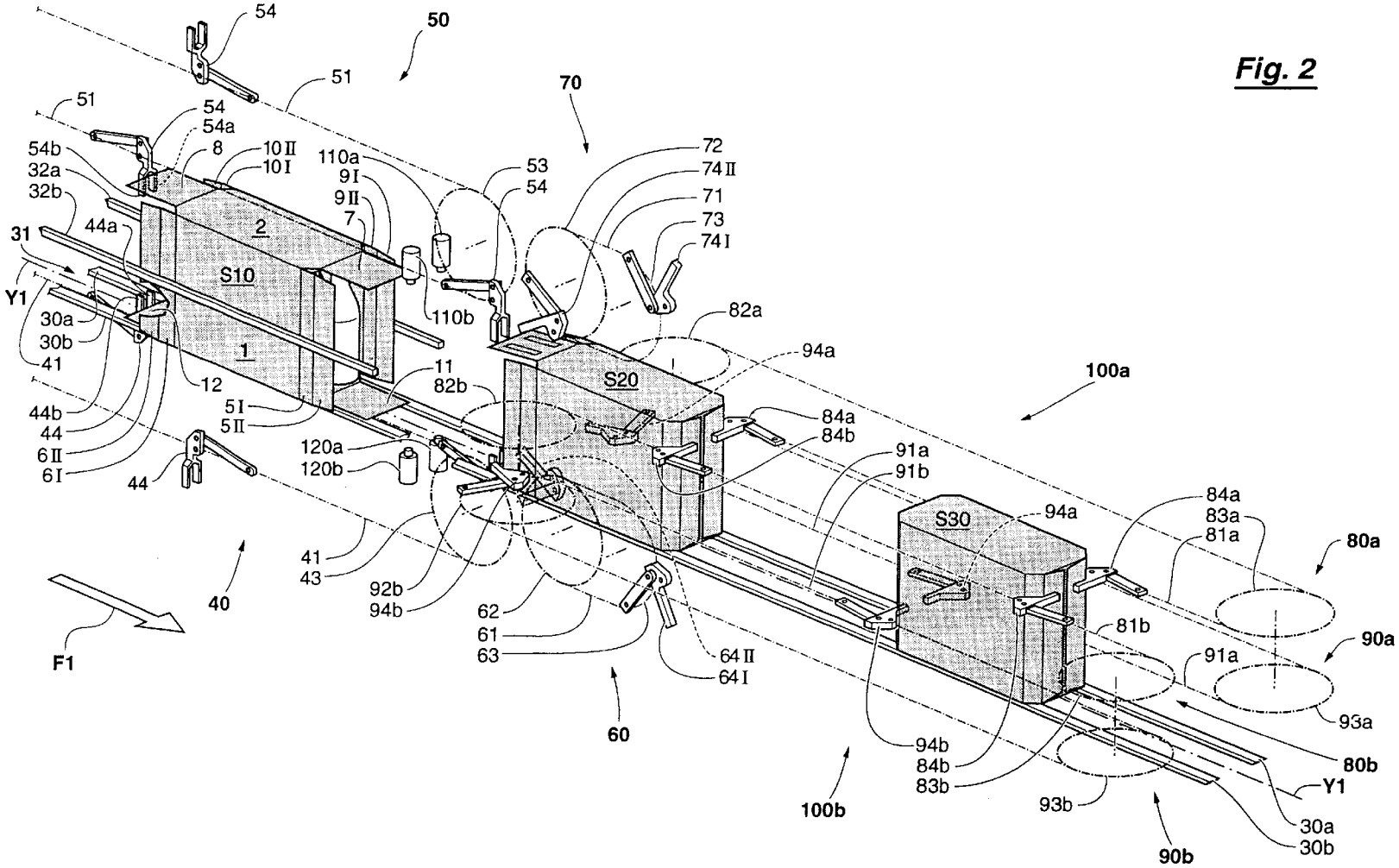
FIG. 2 illustrates in schematic perspective view the method and the system which are the subject of the present invention.
Figure 2A:
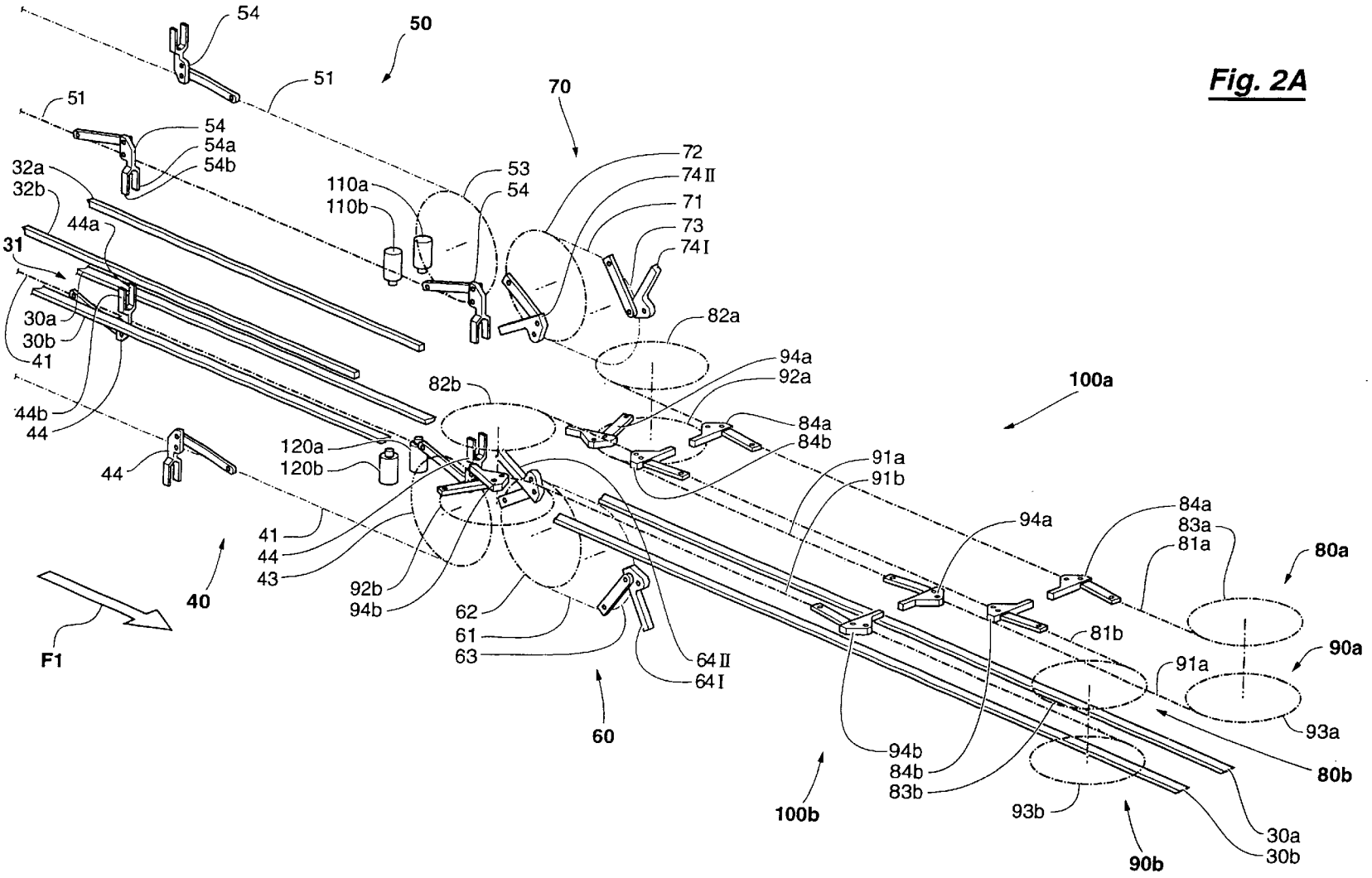
FIG. 2A is a view similar to FIG. 2, in which the half-packages in the form of a sleeve and other parts have been removed, in order better to show the operative elements.
Figure 10:
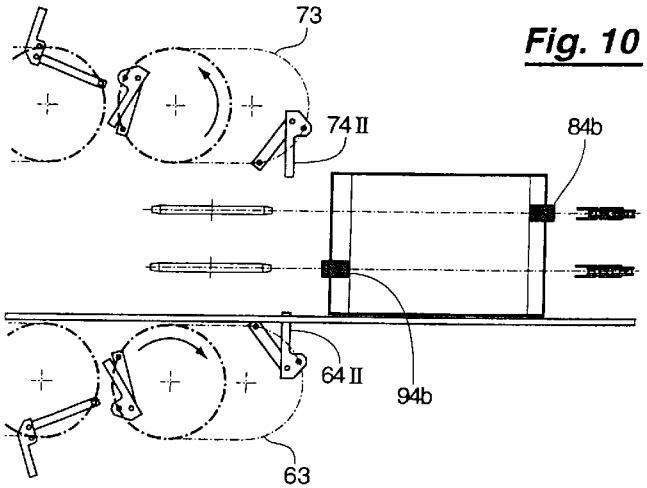
Figure 10A:
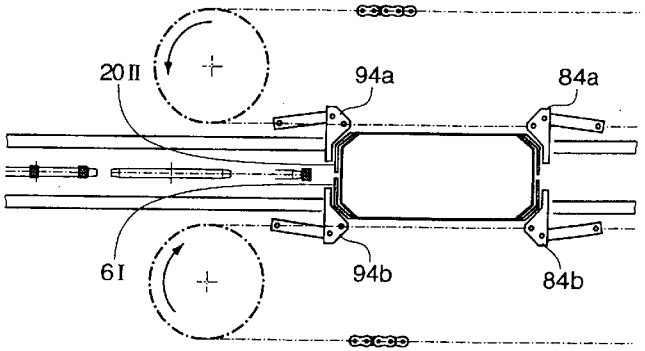

As the half-packages are advanced further in the downstream direction, see FIGS. 10 and 10*a*, when the rear flaps 10I–10II and 6I–6II are partially closed, in order to prevent re-opening of the rear flaps 8 and 12, the upper trust-folder post 74II is deflected upwards, by being moved along the guide chain 73, and the lower trust-folder post 64II is deflected downwards, by being moved along the guide chain 63, and, thus, the thrust-folder post 94*a* of the conveyor 90*a* and the thrust-folder post 94*b* of the conveyor 90*b* fold definitively towards the interior the third rear flap 10I–10II and the first rear flap 6I–6II, thus obtaining the half-package S1 illustrated in FIG. 1, corresponding to the package S30 illustrated in FIG. 2.

Figure 11:
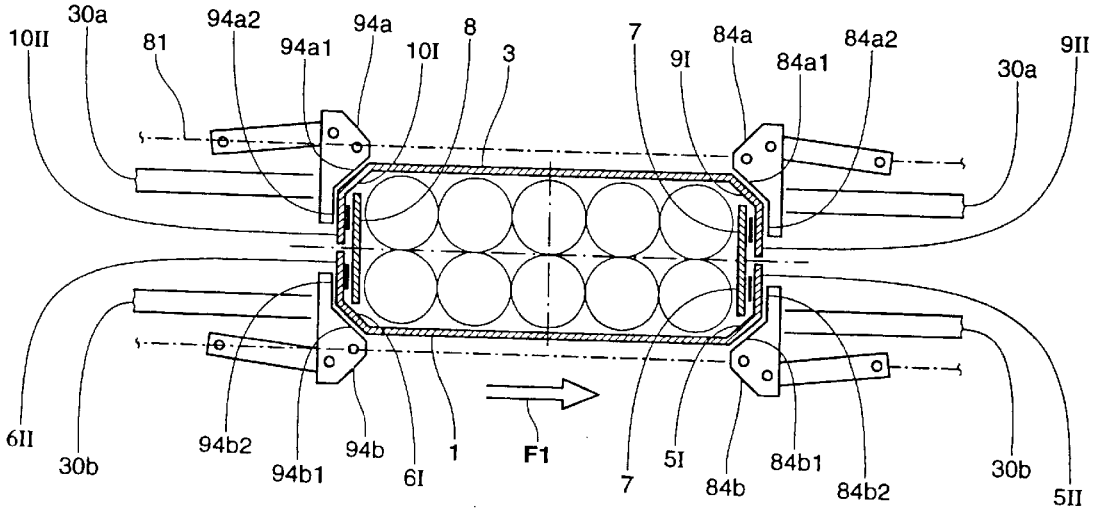
FIG. 11 is a view in cross-section according to the line 11—11 in FIG. 3B.

With reference to FIG. 11, the particular profiles, 84*a*1–84*a*2 and 84*b*1–84*b*2 of the front posts 84*a* and 84*b*, which are designed to close the flaps of the front end side of the half-package, are shaped in relation to the dimensioning of the sub-flaps 9I, 9II and 5I, 5II, such as to fold the respective intermediate sub-flaps 9I and 5I in a bevelled manner, with the required angle, and to fold the end flaps 9II and 5II with the required angle against the flaps 7 and 11, thus obtaining mutual adhesion between the said four latter, owing to the glue which has previously been applied to the said flaps 7 and 11, and then maintain the said folding also during the subsequent advance, in order to allow the glue to adhere fully.

Similarly, again with reference to FIG. 11, the particular profiles 94*a*1–94*a*2 and 94*b*1–94*b*2 of the rear posts 94*a* and 94*b*, which are designed to close the rear end side of the half-package, are shaped in relation to the dimensioning of the sub-flaps 10I, 10II and 6I, 6II, such as to fold the respective intermediate sub-flaps 10I and 6I, in a bevelled manner, with the required angle, and to fold the end flaps 10II and 6II with the required angle, against the flaps 8 and 12, thus obtaining mutual adhesion between the said four latter, owing to the glue which has previously been applied to the said flaps 8 and 12, and then to maintain the said folding during subsequent advance, in order to allow the glue to adhere fully.

The description of the above-described method and packaging machine are provided purely by way of non-limiting example, and thus, all modifications and variations suggested by practice and use, and within the context of the scope of the following claims, can be made to the said method and the said machine.

What is claimed is:

1. A method for closure in succession of closure flaps of two ends of a half-package in the form of a rectangular sleeve, wherein said half-package comprises:

a front end having a first front flap attached at a first front edge to said sleeve, a second front flap attached at a second front edge perpendicular to said first front edge of said sleeve, a third front flap attached at a third front edge parallel to said first front edge of said sleeve and a fourth front flap attached at a fourth front edge parallel to said second front edge of said sleeve, and a rear end side having a first rear flap attached at a first rear edge of said sleeve and parallel to said first front edge, a second rear flap attached at a second rear edge perpendicular to said first rear edge of said sleeve, a third rear flap attached at a third rear edge of said sleeve parallel to said first rear edge and a fourth rear flap attached at a fourth rear edge of said sleeve parallel to said second rear edge, said method comprising the steps of:

(a) displacing a succession of said half-packages in succession linearly along a closure path with respective front end side facing downstream and respective rear end side facing upstream;

(b) applying two transversely spaced longitudinal beads of glue defining between the strips a first front longitudinal strip without glue onto an outer surface of the second front flap in an open position thereof, and applying two transversely spaced longitudinal beads of glue defining between one another a second front longitudinal strip without glue onto an outer surface of the fourth front flap in an open position thereof;

(c) folding inwardly at the front end the second and fourth front flaps by engagement with the first and second longitudinal strips without glue;

(d) thereafter folding inwardly the first and third front flaps to engage them with respective beads of glue on the second and fourth front flaps;

(e) applying two transversely spaced longitudinal beads of glue defining between one another a first rear longitudinal strip without glue onto an outer surface of the second rear flap in an open position thereof, and applying two transversely spaced longitudinal beads of glue defining between one another a second rear longitudinal strip without glue onto an outer surface of the fourth front flap in an open position thereof;

(f) folding inwardly at the rear end the second and fourth rear flaps by engaging the respective rear longitudinal strips without glue; and (g) folding inwardly at the rear end the third and fourth rear flaps to engage them with respective beads glue on of the second and fourth rear flaps.

2. The method defined in claim 1 wherein the first front flap comprises a first intermediate front sub-flap and a first end front sub-flap, the third front flap comprises a third intermediate front sub-flap and a third end front sub-flap, step (d) comprising folding the first and third front flaps to bring the third end front sub-flap and the first end front sub-flap against the second front flap and against the fourth front flap.

3. The method defined in claim 2 wherein the end front sub-flap of the first front flap meets two of said beads of glue disposed near said first front flap and wherein the end front sub-flap of the third front flap meets two of said beads of glue disposed near the said third front flap.

4. The method defined in claim 3 wherein the first rear flap comprises a first intermediate rear sub-flap and a first end rear sub-flap, the third rear flap comprises a third intermediate rear sub-flap and a third end rear sub-flap, step (d) comprising folding the first and third rear flaps to bring the third end rear sub-flap and the first end rear sub-flap against the second rear flap and against the fourth rear flap.

5. The method defined in claim 4 wherein the end rear sub-flap of the first rear flap meets two of said beads of glue disposed near said first rear flap and wherein the end rear sub-flap of the third rear flap meets two of said beads of glue disposed near the said third rear flap.

6. An apparatus for closure in succession of the closure flaps of the two ends of half-packages (S) in the form of a sleeve, wherein each half-package comprises a first front flap (5I–5II), a first rear flap (6I–6II), a second front flap (7I), a second rear flap (8), a third front flap (9I–9II), a third rear flap (10I–10II), a fourth front flap (11) and a fourth rear flap (12), said apparatus comprising:

first thrust means (50–54*a*–54*b*; 40–44*a*–44*b*; 30*a*–30*b*; 32*a*–32*b*) for supplying a sequence of said half-packages (S) in succession along a transport path along a translation-closure line (Y1);

first gluing means (110*a*–110*b*) along said transport path and in the vicinity of the second front flaps (7) and of the second rear flaps (8) for applying glue on outer surfaces of the second front flaps (7) and on outer surfaces of the second rear flaps (8) while the half-packages (S) are moved in a downstream direction in succession;

second gluing means (120*a*–120*b*) disposed along said path and in the vicinity of the fourth front flaps (11) and of the fourth rear flaps (12) for applying glue on outer surfaces of the fourth front flaps (11) and on outer surfaces of the fourth rear flaps (12), whilst the half-packages (S) are moved in said direction in succession;

first thrust-folder means (70, 71, 74I–74II), comprising first thrust-folder posts (74I–74II), which move longitudinally in the vicinity of the area said second front flaps (7) and of the second rear flaps (8) along said path for folding inwardly the second front flaps (7) and the second rear flaps (8), during movement of the half-packages (S) in said direction;

second thrust-folder means (60, 61, 64I–64II) along said path comprising second thrust-folder posts (64I–64II), which move longitudinally in the vicinity of the fourth front flaps (11) and of the fourth rear flaps (12) for folding inwardly the fourth front flaps (11) and the fourth rear flaps (12) during movement of the half-packages (S) in the downstream direction;

third thrust-folder means (100*a*, 80*a*, 90*a*, 84*a*, 94*a*) along said path comprising third thrust-folder posts (84*a*, 94*a*), which move longitudinally in the vicinity of the third front flaps (9I–9II) and of the third rear flaps (10I–10II) for folding inwardly the third front flaps (9I–9II) and the third rear flaps (10I–10II), during movement of the half-packages (S) in the downstream direction;

fourth thrust-folder means (100*b*, 80*b*, 90*b*, 84*b*, 94*b*) along said path comprising fourth thrust-folder posts (84*b*, 94*b*), which move longitudinally in the vicinity of the first front flaps (5I–5II) and of the first rear flaps (6I–6II) for folding inwardly the first front flaps (5I–5II) and the first rear flaps (6I–6II), during movement of the half-packages (S) in the downstream direction; and support means (30*a*, 30*b*) along said path, which extend longitudinally, in order to support the half-packages (S) during movement thereof in the downstream direction.

7. The apparatus defined in claim 6 wherein, in order to supply the half-packages (S1, S2, etc.) in individual succession along said translation-closure line (Y1), said first thrust means (54; 44; 30*a*–30*b*; 32*a*–32*b*) comprises:

two longitudinal track supports (30*a*, 30*b*), which extend longitudinally, in order to support the half-packages (S) during their translation in the downstream direction;

two lateral guides (32*a* and 32*b*), which extend longitudinally, in order to channel the half-packages (S) during their translation in the downstream direction;

a first upper conveyor (50) with a chain (51), which is wound in a closed path, in order to make the thrust posts (54) move in an orbit which is disposed on a vertical-longitudinal plane, wherein, along the lower branch of the said path, the longitudinal posts (54) thrust on the rear flap of the second rear flaps (8); and a first lower conveyor (40) with a chain (41), which is wound in a closed path in order to make the thrust posts (44) move in an orbit which is disposed on a vertical-longitudinal plane, wherein, along the upper branch of the said path, the thrust posts (44) thrust on the rear flap of the fourth rear flaps (12).

8. The apparatus defined in claim 6 wherein said first gluing means (110*a*, 110*b*) provide two longitudinal beads of glue (21*a*, 21*b*), which are spaced transversely on the second front flaps (7), defining between one another a front longitudinal strip (22) without glue, and two longitudinal beads of glue (25*a*, 25*b*) which are spaced transversely on the second rear flaps (8), defining between one another a rear longitudinal strip (26) without glue, said first thrust-folder posts (74I, 74II) act upon said second front flaps (7) at said front longitudinal strip (22) without glue, and fold the said second rear flaps (8), acting on said rear longitudinal strip (26) without glue.

9. The apparatus defined in claim 6 the said second gluing means (120*a*, 120*b*) provide two longitudinal beads of glue (23*a*, 23*b*), which are spaced transversely on the fourth front flaps (11), defining between one another a front longitudinal strip (24) without glue, and two longitudinal beads of glue (27*a*, 27*b*), which are spaced transversely on the fourth rear flaps (12), defining between one another a rear longitudinal strip (28) without glue, and said second thrust-folder posts (64I, 64II) fold the said second front flaps (11), acting in the vicinity of the said front longitudinal strip (24) without glue, and fold the said second rear flaps (12), acting in the vicinity of the said rear longitudinal strip (28) without glue.

10. The apparatus defined in claim 6 wherein the said first thrust-folder means (74I–74II) comprise a conveyor (70) with a chain (71), which is wound in a closed path, said chain (71) makes a plurality of thrust-folder posts (74I, 74II) move in an orbit with a closed path, and said orbit has an operative branch which extends longitudinally in the vicinity of the area of translation of the second front flaps (7) and of the second rear flaps (8).

11. The apparatus defined in claim 6 wherein the said second trust-folder means (64I–64II) comprise a conveyor (60) with a chain (61), which is wound in a closed path, the said chain (61) makes a plurality of thrust-folder posts (64I, 64II) move in an orbit with a closed path, and the said orbit has an operative branch which extends longitudinally in the vicinity of the area of translation of the fourth front flaps (11) and of the fourth rear flaps (12).

12. The apparatus defined in claim 6 wherein the said third trust-folder posts (84*a*; 94*a*) have an operative abutting surface, which is provided with a shaped profile (84*a*1–84*a*2; 94*a*1–94*a*2).

13. The apparatus defined in claim 6 wherein each half-package (S) has a third front flap (9I–9II), comprising an intermediate sub-flap (9I), and an end sub-flap (9II), the said third trust-folder posts (84*a*, 94*a*) have front thrust-folder posts (84*a*) with an operative surface having a shaped profile comprising an inclined segment (84*a*1)for folding the intermediate sub-flap (9I), and a transverse segment (84*a*2) for folding the end sub-flap (9II).

14. The apparatus defined in claim 6 wherein each half-package (S) has a third rear flap (10I–10II) comprising an intermediate sub-flap (10I), and an end sub-flap (10II), and the said third thrust-folder posts (84*a*, 94*a*) have rear thrust-folder posts (94*a*) with an operative surface having a shaped profile comprising an inclined segment (94*a*1) for folding the intermediate sub-flap (10I), and a transverse segment (94*a*2) for folding the end sub-flap (10II).

15. The apparatus defined in claim 6 wherein said third thrust-folder means (100*a*, 80*a*, 90*a*, 84*a*, 94*a*) comprises a conveyor (100*a*) with a chain (81*a*, 91*a*), which is wound in a closed path, chains (81*a*, 91*a*) make a plurality of thrust-folder posts (84*a*, 94*a*) move in orbits with a closed path, and said orbits have operative branches which extend longitudinally in the vicinity of the third front flaps (9I, 9II) and the third rear flaps (10I, 10II).

16. The apparatus defined in claim 15 wherein said conveyor (100*a*) comprises a first chain (81*a*), which is wound in a closed path, in order to support front thrust-folder posts (84*a*), and a second chain (91*a*), which is wound in a closed path, in order to support rear thrust-folder posts (94*a*), said front thrust-folder posts (84*a*) fold the third front flaps (9I–9II), and said rear thrust-folder posts (94*a*) fold the third rear flaps (10I–10II).

17. The apparatus defined in claim 6 wherein said fourth thrust-folder posts (84*b*, 94*b*) have operative abutting surfaces provided with a shaped profile (84*b*1–84*b*2, 94*b*1–94*b*2).

18. The apparatus defined in claim 6 wherein each half-package (S) has a first front flap (5I–5II), comprising an intermediate sub-flap (5I), and an end sub-flap (5II), said fourth thrust-folder posts (84*b*, 94*b*) have front thrust-folder posts (84*b*) with operative surfaces having a shaped profile comprising an inclined segment (84*b*1) for folding the intermediate sub-flap (5I), and a transverse segment (84*b*2) for folding the end sub-flap (5II).

19. The apparatus defined in claim 6 wherein each half-package (S) has a third rear flap (6I–6II) comprising an intermediate sub-flap (6I), and an end sub-flap (6II), said fourth trust-folder posts (84*b*, 94*b*) have rear thrust-folder posts (94*b*) with operative surfaces having a shaped profile comprising an inclined segment (94*b*1) for folding the intermediate sub-flap (6I), and a transverse segment (94*b*2) for folding the end sub-flap (6II).

20. The apparatus defined in claim 19 wherein the said fourth thrust-folder means (100*b*, 80*b*, 90*b*, 84*b*, 94*b*) comprises a conveyor (100*b*) with a chain (81*b*, 91*b*) which is wound in a closed path, the said chains (81*b*, 91*b*) make a plurality of thrust-folder posts (84*b*, 94*b*) move in orbits with a closed path, and the said orbits have operative branches which extend longitudinally in the vicinity of the first front flaps (5I, 5II), and of the first rear flaps (6I, 6II).

21. The apparatus defined in claim 20 wherein said conveyor (100*b*) comprises a first chain (81*b*) which is wound in a closed path, in order to move front thrust-folder posts (84*b*), and a second chain (91*b*), which is wound in a closed path, in order to support rear thrust-folder posts (94*b*), the said front thrust-folder posts (84*b*) fold the first front flaps (5I–5II), and said rear thrust-folder posts (94*b*) fold the first rear flaps (6I–6II).

22. The apparatus defined in claim 6 wherein said first thrust-folder means (74I–74II) are supported by means of a first thrust-folder conveyor (70),said second thrust-folder means (64I–64II) are supported by means of a second thrust-folder conveyor (70), the said third thrust-folder means (84*a*, 94*a*) are supported by means of a third thrust-folder conveyor (100*a*), the fourth thrust-folder means (84*b*, 94*b*) are supported by means of a fourth thrust-folder conveyor (100*b*), and said thrust-folder conveyors (60, 70, 100*a*, 100*b*) together are in the configuration of a cross which extends longitudinally, in the center of which the translation-closure line is disposed.

23. The apparatus defined in claim 6 wherein said support means (30*a*, 30*b*) comprise two longitudinal track supports (30*a*, 30*b*), which extend longitudinally, in order to support the half-packages (S) during movement in the downstream direction along the translation-closure line (Y1).

* * * * *